US006840322B2

(12) United States Patent
Haynes et al.

(10) Patent No.: US 6,840,322 B2
(45) Date of Patent: Jan. 11, 2005

(54) SUBSEA WELL INTERVENTION VESSEL

(75) Inventors: Anthony P. Haynes, Nesoya (NO); Colin Jones, Stabekk (NO)

(73) Assignee: Multi Opertional Service Tankers Inc. (PA)

( * ) Notice: Subject to any disclaimer, the term of this patent is extended or adjusted under 35 U.S.C. 154(b) by 0 days.

(21) Appl. No.: 10/149,951

(22) PCT Filed: Dec. 20, 2000

(86) PCT No.: PCT/GB00/04899

§ 371 (c)(1),
(2), (4) Date: Jun. 17, 2002

(87) PCT Pub. No.: WO01/48351

PCT Pub. Date: Jul. 5, 2001

(65) Prior Publication Data

US 2003/0000740 A1 Jan. 2, 2003

(30) Foreign Application Priority Data

Dec. 23, 1999 (GB) ..... 9930450

(51) Int. Cl.[7] ..... E21B 29/12

(52) U.S. Cl. ..... 166/352; 166/357; 166/358; 175/7

(58) Field of Search ..... 166/352, 357, 166/358, 359; 175/7, 8, 5

(56) References Cited

U.S. PATENT DOCUMENTS 3,802,209 A 4/1974 Weaver
4,448,568 A * 5/1984 Gentry et al. ..... 408/168.3
5,720,356 A * 2/1998 Gardes ..... 175/62
5,727,640 A * 3/1998 Gleditsch ..... 175/7
5,749,758 A * 5/1998 Breivik et al. ..... 441/5
5,873,420 A * 2/1999 Gearhart ..... 175/25
6,019,174 A * 2/2000 Korsgaard ..... 166/352
6,085,851 A * 7/2000 Scott et al. ..... 175/7
6,234,258 B1 * 5/2001 Karigan ..... 175/66
6,273,193 B1 * 8/2001 Hermann et al. ..... 166/359
6,328,107 B1 * 12/2001 Maus ..... 166/335
6,367,402 B1 * 4/2002 Weiler ..... 114/259
6,415,877 B1 * 7/2002 Fincher et al. ..... 175/5
6,450,262 B1 * 9/2002 Regan ..... 166/350
6,453,838 B1 * 9/2002 Mowell et al. ..... 114/230.13
6,474,422 B2 * 11/2002 Schubert et al. ..... 175/69
6,536,540 B2 * 3/2003 de Boer ..... 175/70

FOREIGN PATENT DOCUMENTS

GB 2162880 A 2/1986
WO WO 97/42393 11/1997
WO WO 99/49172 9/1999

* cited by examiner

*Primary Examiner*—Thomas B. Will
*Assistant Examiner*—Thomas A Beach
(74) *Attorney, Agent, or Firm*—Michael Best & Friedrich LLP

(57) ABSTRACT

A subsea well intervention vessel including a dynamically positionable tanker and direct well intervention equipment mounted on a deck of the tanker. The direct well intervention equipment is mounted on a superstructure above the main deck of the tanker and includes equipment for underbalanced non-rotating drilling and hydrocarbon liquid separation. The liquid separation equipment is coupled to storage tanks of the tanker so as to receive separated hydrocarbon liquids for storage purposes.

6 Claims, 4 Drawing Sheets

SUBSEA WELL INTERVENTION VESSEL

The present invention relates to a subsea well intervention vessel.

Hydrocarbon production wells are established by using a rotating drill assembly. A rotating drill assembly is driven from the surface, generally in the case of a subsea well from a rig mounted on a platform positioned over the well. The platform can be mounted on the seabed or may be a semi-submersible assembly the location of which can be maintained in all but the most extreme conditions. After completion of drilling, the well is lined with tubing to enable hydrocarbon liquids to flow through the tubing from any hydrocarbon reserve into which the tubing extends. In some formations, hydrocarbon fluids and water occupy the same reservoir, the hydrocarbon fluids forming a layer on top of the water. If the production tubing of a well penetrates the formation initially occupied by the hydrocarbon fluids, as fluid flows to the well tubing the phenomenon known as "water coning" can occur, that is the interface between the hydrocarbon liquids and water slopes upwards towards the well. This effect results from pressure gradients established within the reservoir formation as a result of fluid flow through the formation to the well tubing. If the tip of the cone-shaped interface reaches the well tubing, large volumes of water will enter the well tubing, reducing the rate of hydrocarbon liquid production and increasing the costs of separating the produced hydrocarbon fluids from the water.

In wells where water coning has become a problem, it is known to conduct further drilling operations so as to prevent or minimise water cone generation. For example, a bottom hole drilling assembly can be used to drill lateral passageways into the hydrocarbon liquid-bearing formation. This can be achieved by using conventional drilling techniques, but such techniques demand the shutting down of the well and often require the removal of the tubing lining the well. This involves substantial costs and risks. In addition, the hydrocarbon liquid bearing formation can be damaged by drilling fluids required for the additional drilling operations.

In order to avoid the possibility of loss or damage to a well resulting from drilling interventions, an advanced drilling technology has been developed which allows technically difficult drilling to be achieved without substantial risk of damage to the formation. The technique is referred to as "underbalanced" drilling. With underbalanced drilling, the well is live (positive pressure at the surface) at all times. This can be achieved by either using a lightweight drilling fluid or relying upon gas lift control using a purpose-built blow out preventer assembly. A clean drilling fluid is pumped down the well, and this mixes with the formation fluids that are allowed to flow up the well, that flow transporting the rock cuttings to the surface. The five phases (gas, oil, formation water, drilling fluid and drilling solids) are then separated. On land this is a straightforward process as space is not at a premium. The equipment however is large and has not been thought suited for offshore operations.

Underbalanced drilling can be conducted using either conventional rotary drilling or coiled tubing drilling. In the UK sector of the North Sea four wells have been drilled using underbalanced rotary drilling but this has only been possible using relatively large fixed (seabed-supported) platforms. On land, coiled tubing drilling has been used. In these known applications, a long seamless pipe which is stored on a drum is pushed into the well by an injector against the live well pressure. A turbine drill is mounted on the bottom end of the pipe and hydraulic pressure is delivered to the turbine drill through the pipe. This drives the turbine and permits drilling to take place. The small diameter of the pipe (typically 1 to 2 ⅞") makes it possible for the pipe to pass through existing well-lining tubing (normally referred to as completions) so that it is not necessary to incur the substantial costs and risks of removing such tubing.

Light intervention vessels are available which make it possible to conduct operations such as well servicing, e.g. well logging and general maintenance. Such vessels however cannot be considered appropriate platforms for interventions requiring drilling as they are not sufficiently stable for such operations and furthermore could not operate underbalanced drilling as they are too small to handle the volumes of material that result in such drilling. Furthermore, light intervention vessels require large capital investments as compared with the returns that can be generated, particularly as they are highly vulnerable to bad weather such that intervention costs are relatively high and utilisation time is relatively low. It would of course be possible to use a semi-submersible for well interventions but semi-submersibles cannot be used as yet for underbalanced drilling. Even such an approach would require support vessels to receive the produced liquids and solids. Accordingly no attempts have been made to use underbalanced coiled tubing drilling from floating units.

It is an object of the present invention to provide a subsea well intervention vessel capable of re-entering existing production wells in a manner which allows well interventions to be performed without removing the well from its production mode and without polluting the subsea production system with well intervention effluent, e.g. drilling solids.

According to the present invention, there is provided a subsea well intervention vessel comprising a dynamically positionable tanker and direct well intervention equipment mounted on the deck of the tanker, the direct well intervention equipment including equipment for underbalanced non-rotating drilling and hydrocarbon liquid separation coupled to storage tanks of the tanker such that separated hydrocarbon liquids can be stored in the tanker.

The invention also provides a method for conducting off-shore underbalanced drilling, wherein a tanker having direct well intervention equipment mounted on its deck is dynamically positioned over a riser extending from a subsea well, the well intervention equipment is coupled to the riser, and underbalanced non-rotating drilling is performed, the resultant multi-phase mixture being separated on the tanker and separated hydrocarbon liquids being stored in storage tanks of the tanker.

The term "non-rotating drilling" is used herein to include any drilling in which there is no rotation of the drill string including but not limited to underbalanced drilling using a rotary drill head powered through a non-rotating drill string.

The well intervention equipment may be mounted on a superstructure above the main deck of a conventional shuttle tanker. Coiled tubing equipment may be mounted adjacent a skid deck which may be displaced to an outboard position over a well riser to which the coiled tubing equipment is to be connected. Thus a well intervention can be achieved by dynamically positioning the shuttle tanker adjacent a well riser, moving the skid deck to the outboard position, coupling the coiled tubing equipment to the riser, and performing the necessary interventions in the well to which the riser is connected, fluids and solids produced during the coiled tubing drilling process being separated by equipment mounted on the superstructure and hydrocarbon liquids being transferred from the separation equipment to the shuttle tanker storage hold.

As an alternative to providing a skid deck displaceable to an outboard position, the drilling equipment could be mounted adjacent a moon pool extending through the tanker deck.

Embodiments of the present invention will now be described, by way of example, with reference to the accompanying drawings, in which.

Figure 1:
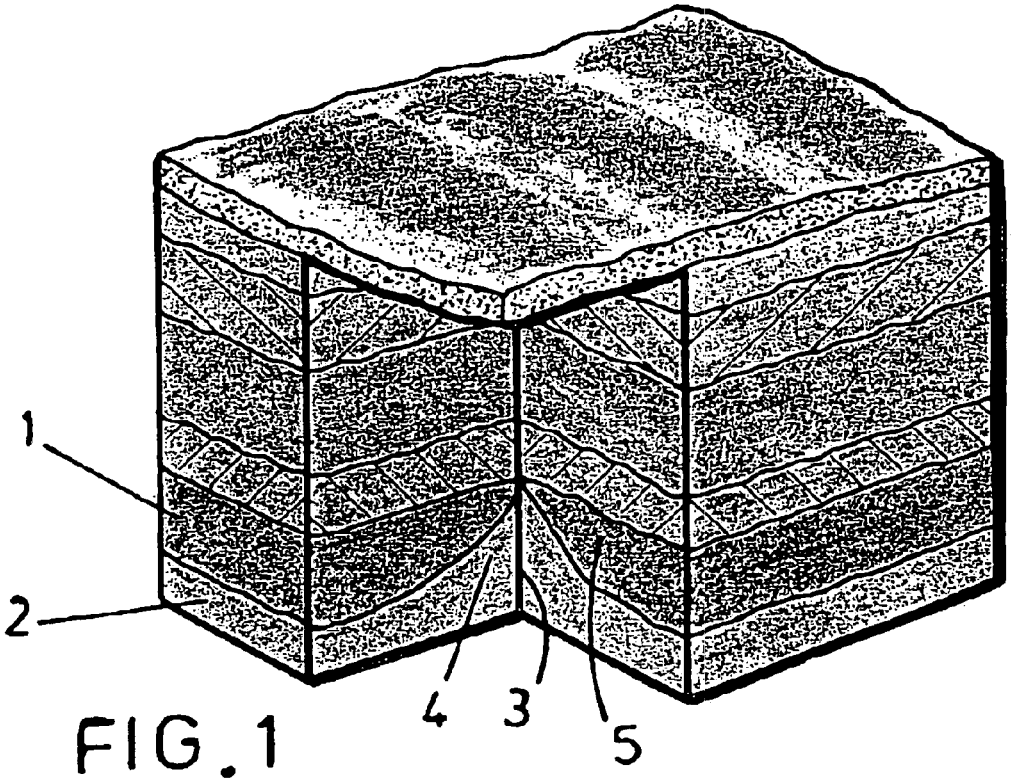
FIG. 1 is a schematic representation taken from an available document showing the phenomenon of water coning.
Figure 2:
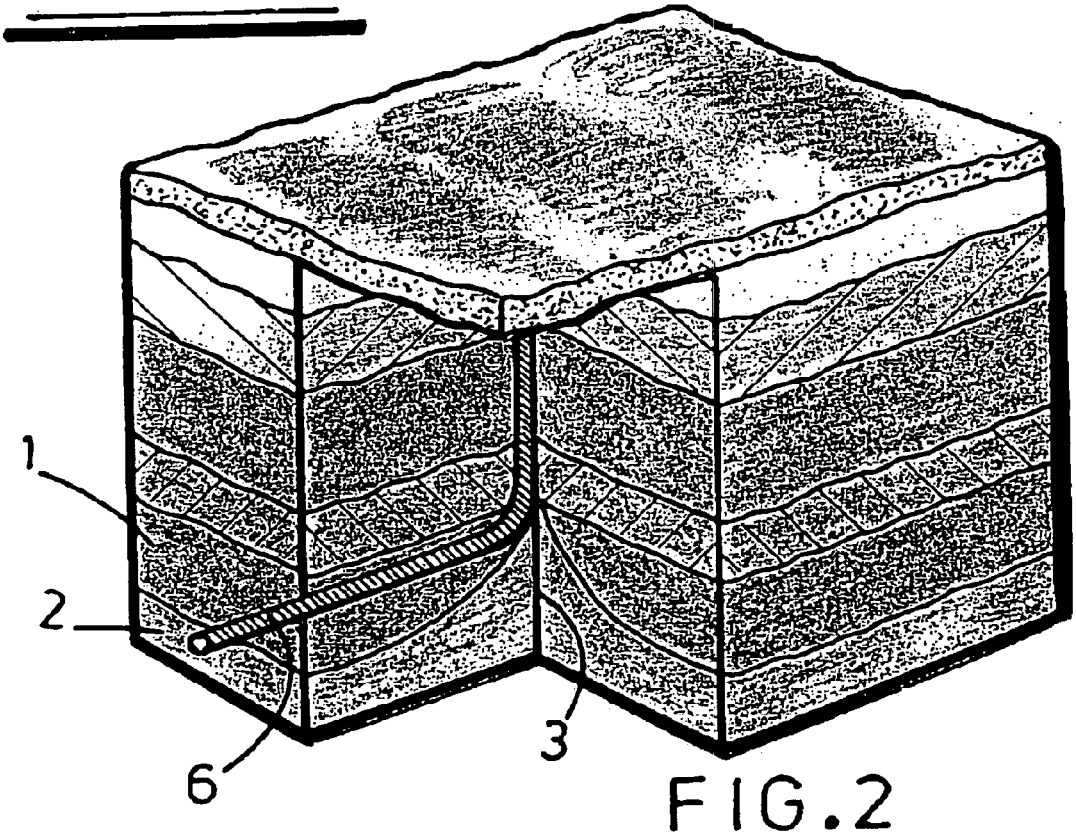
FIG. 2 is a further illustration taken from a published document showing the results of coiled tubing drilling in the structure of FIG. 1 so as to improve the rate of production of hydrocarbon liquids.

Referring to FIG. 1, this illustrates a series of strata incorporating a hydrocarbon bearing stratum 1 which lies over a water bearing stratum 2. A well 3 is drilled through the strata 1 and 2. Pressure within the hydrocarbon liquid and water is such that flow is established to the well 3. As a result of that flow a "water cone" 4 is defined around the well 3 and as a result a conical interface 5 is established between the hydrocarbon liquid and water. If the well 3 is lined with steel tubing down to the top of the strata 1, and the water cone reaches to adjacent the lined portion of the well, large volumes of water will be produced. Clearly this is highly disadvantageous and therefore it is known to intervene in wells which suffer from the water coning effect. FIG. 2 illustrates the results of such an intervention.

Referring to FIG. 2, a branch well 6 is shown as being drilled into the stratum 1. Drilling such a branch 6 can substantially improve the proportion of produced liquids made up by hydrocarbon liquids. It is well known to form a branch such as the branch 6 of FIG. 2 using coiled tubing drilling techniques. It is necessary however when using such techniques to maintain underbalanced conditions (that is maintain a positive pressure at the top of the well 3) in order to avoid drilling solids damaging the well. Such techniques have never been used offshore because the volume of material generated can only be handled in large installations.

Figure 3:
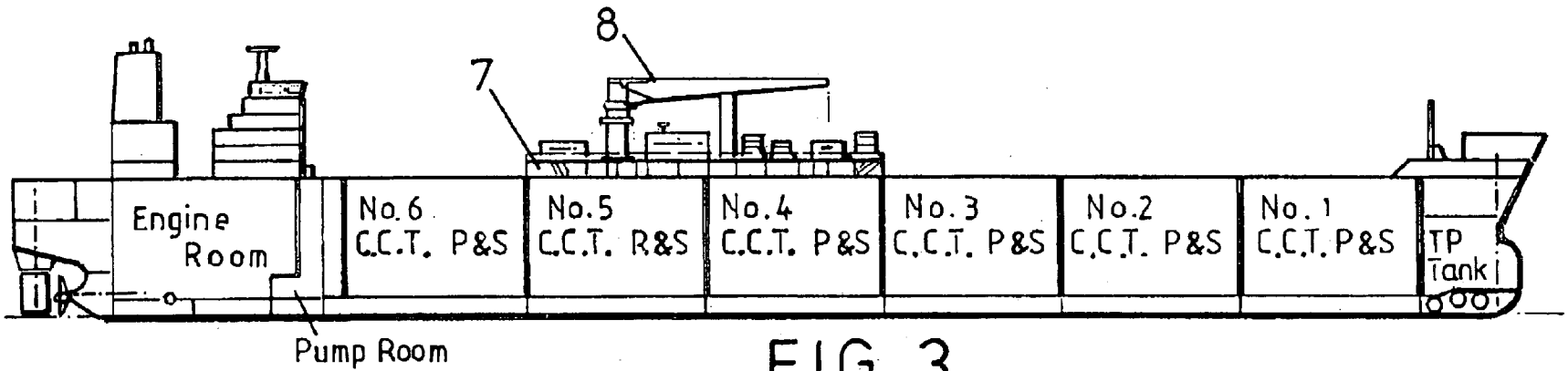
FIG. 3 is a side view of a known North Sea shuttle tanker incorporating direct well intervention equipment in accordance with the present invention.

FIG. 3 illustrates a shuttle tanker embodying the present invention. FIG. 3 is based on a drawing extracted from "First Olsen Tankers" and shows a shuttle tanker of the type widely used in the North Sea. The only modification made to the standard shuttle tanker is the mounting of a superstructure 7 above the main deck of the tanker, for example at a height of approximately 3 m so as to clear the installed deck pipes and vents. On that superstructure all the equipment necessary for direct well intervention is mounted, including a crane 8. The detailed layout of the equipment mounted on the superstructure 7 of FIG. 3 is shown in FIG. 4.

Figure 4:
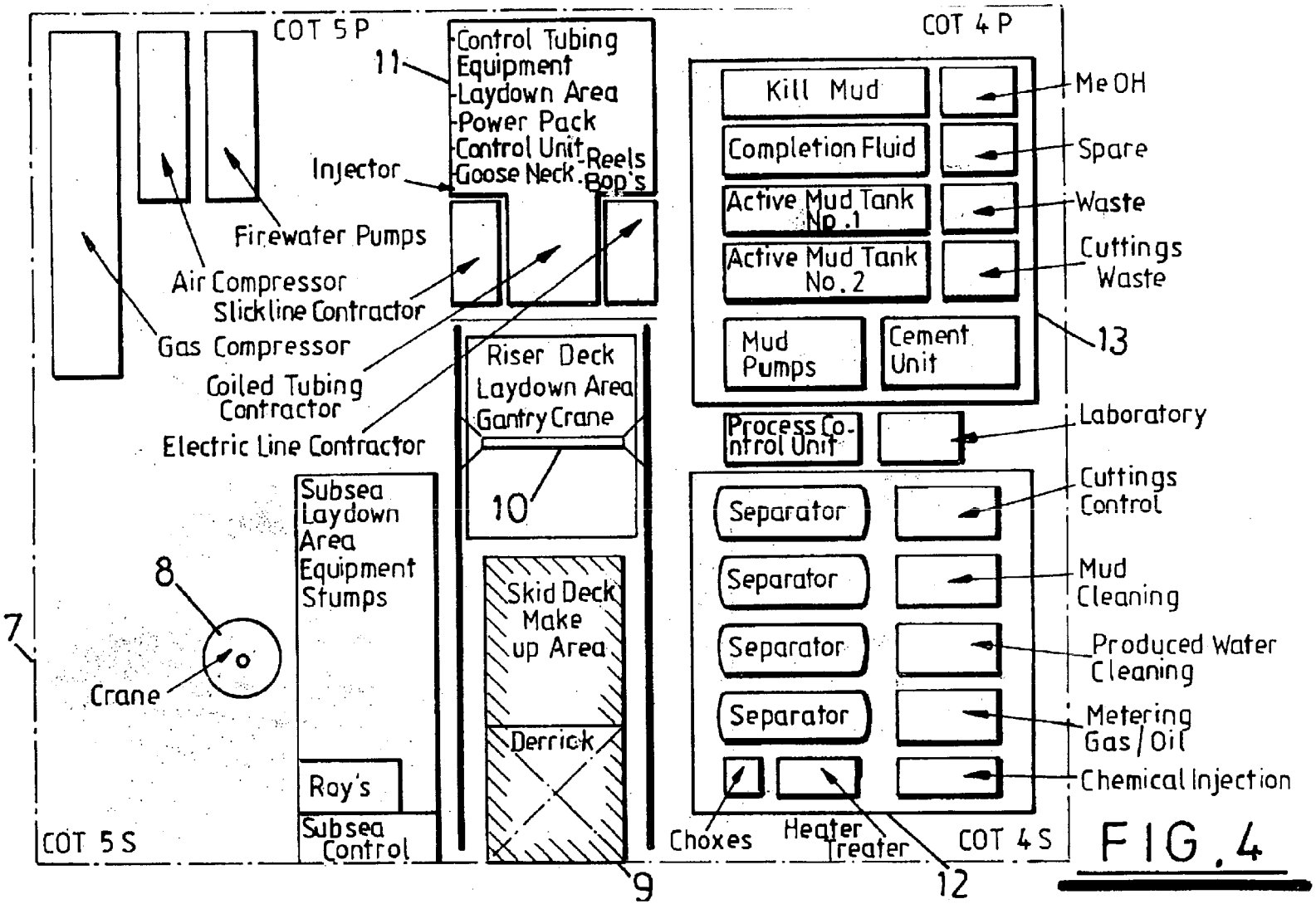
FIG. 4 is a schematic layout diagram of the direct well intervention equipment shown in side view in FIG. 3.

Referring to FIG. 4, a skid deck 9 is centrally mounted on the superstructure 7 adjacent a gantry crane 10. Coiled tubing drilling equipment 11 of conventional form is mounted adjacent the gantry crane 10. A separator assembly 12 and ancillary drilling support equipment assembly 13 are also mounted on the superstructure 7. All other equipment relied upon to achieve the required direct well intervention is also mounted on the superstructure 7. The separator assembly 12 is coupled to an appropriately positioned flare stack, for example at the stern of the vessel (not shown) and to the storage tanks of the tanker so as to enable produced hydrocarbon fluids to be stored for subsequent transport.

In use, the tanker is dynamically positioned adjacent a subsea well riser. The skid deck 9 is then moved to an outboard position (not shown) over the riser to enable the coiled tubing equipment 11 to be coupled to the riser. Appropriate interventions can then be made via the riser and in particular coiled tubing drilling can be conducted in a manner which produces a multiphase mixture that is subsequently separated into its different phases in the separator assembly 12.

The system described with reference to FIGS. 3 and 4 represents a breakthrough in offshore drilling, testing, waste disposal and well maintenance. The tanker cargo holds can be used for the collection of produced oil during underbalanced drilling. The system can give direct access to test subsea wells for extended durations. The system can be used for an extended water injection test and also allows for the disposal of waste into a subsea well. Existing systems in contrast cannot perform coiled tubing drilling and cannot collect produced oil, requiring a separate shuttle tanker in the event that oil is being produced during drilling.

Furthermore the original features of the shuttle tanker are maintained and therefore the vessel can still be employed in the charter market when not being used for direct well interventions. As a result the invention offers a solution to the problem of achieving direct well interventions with coiled tubing drilling without the major costs associated with building and operating specialist vessels.

A standard North Sea specified shuttle tanker with dynamic positioning can be readily chartered and fitted with a new deck above the installed deck pipes and vents. On that deck appropriate equipment can be installed such as:

- A skid mounted derrick riser handling unit with subsea control panel;
- Stumps for the subsea well intervention equipment;
- A pipe rack;
- Coiled tubing reels, control unit and power pack;
- Cementing unit and blender;
- Production test equipment including choke manifold, heater treater, separators, degassing boot and gas flare;
- Tanks for kill mud;
- A closed circulation system for handling drilling mud and drilled solids during underbalanced drilling;
- Storage tanks for chemical and solid wastes;
- Craneage for subsea equipment and supplies;
- Remote controlled vehicles for working and observation tasks;
- Water supplies for cooling and fire fighting services;

It is probably the case that there are of the order of 2000 subsea completions currently operative. With the present invention, such completions could be made accessible for of the order of 100,000 US dollars per day in contrast with currently quoted costs of the order of 200,000 to 300,000 US dollars per day. Thus the invention dramatically affects the technical capability of the offshore industry in the context of the financial constraints which face that industry.

Coiled tubing drilling solutions include a cost-effective bottom assembly for standard mud systems and a wireline-based bottom hole assembly that fully exploits the benefits of through-tubing drilling, including use of foam and air systems. The present invention allows onshore underbalanced drilling technology to be transferred offshore without requiring extended equipment development. It also permits the production of significant volumes of hydrocarbons without requiring additional storage vessels, thereby reducing demands on cash flow whilst simultaneously avoiding damage to a well as a result of drilling operations. The motion characteristics of a relatively large shuttle tanker are more suited for delicate underbalanced drilling operations then the available relatively smaller and more buoyant alternative vessels. This extends the amount of time that weather permits operation and reduces fatigue stress on the coiled tubing where it is fed from the tanker to the subsea well riser. The invention also allows wells to be properly cleaned after interventions, thereby avoiding polluting the sometimes sensitive production system. Drilling waste can be managed in an optimal fashion, and all this can be achieved in relative safety given the large deck space available. All of these advantages are unavailable if using either a conventional semi-submersible vessel or a conventional purpose-built well intervention vessel.

In the embodiment of the invention described with reference to FIGS. 3 and 4, components necessary for the operation of the invention are mounted on a skid deck which can be moved to an outboard position. In an alternative arrangement illustrated in FIG. 5, such components are mounted adjacent moon pools extending through the structure of an otherwise conventional tanker.

Figure 5:
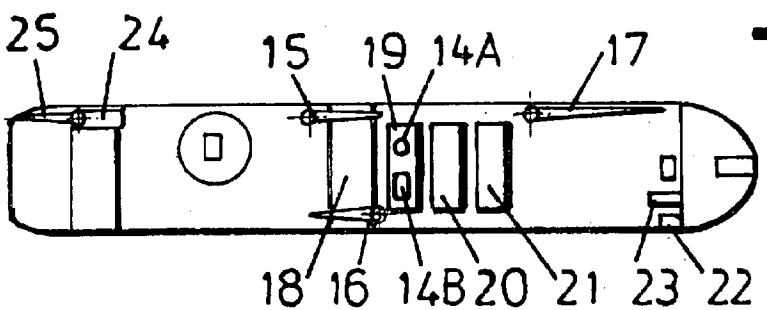
FIG. 5 is a schematic illustration of a tanker which defines moon pools through which coiled tubing drilling can be performed.

Referring to FIG. 5, two moon pools 14A and 14B extend vertically through the structure of a modified shuttle tanker. Three cranes 15, 16 and 17 can extend over the moon pools and areas indicating cargo manifolds 18, a derrick module 19, and a lay down area 20. Area 21 houses gas compression and process units, area 22 a flare boom, area 23 a flare knock-out drum skid, and area 24 a further lay down area served by a crane 25.

Taking a standard double hull shuttle tanker, the modifications required to produce the vessel schematically illustrated in FIG. 5 which can function in accordance with the present invention would be an upgrade of the dynamic positioning capability, installation of a first moon pool (8 $m^2$) for intervention work, installation of a second moon pool (4 $m^2$) for remotely operated vehicle work, mounting of cranes, process equipment and lay down areas for deck-mounted equipment, and the mounting of flare facilities and associated utilities.

Figure 6:
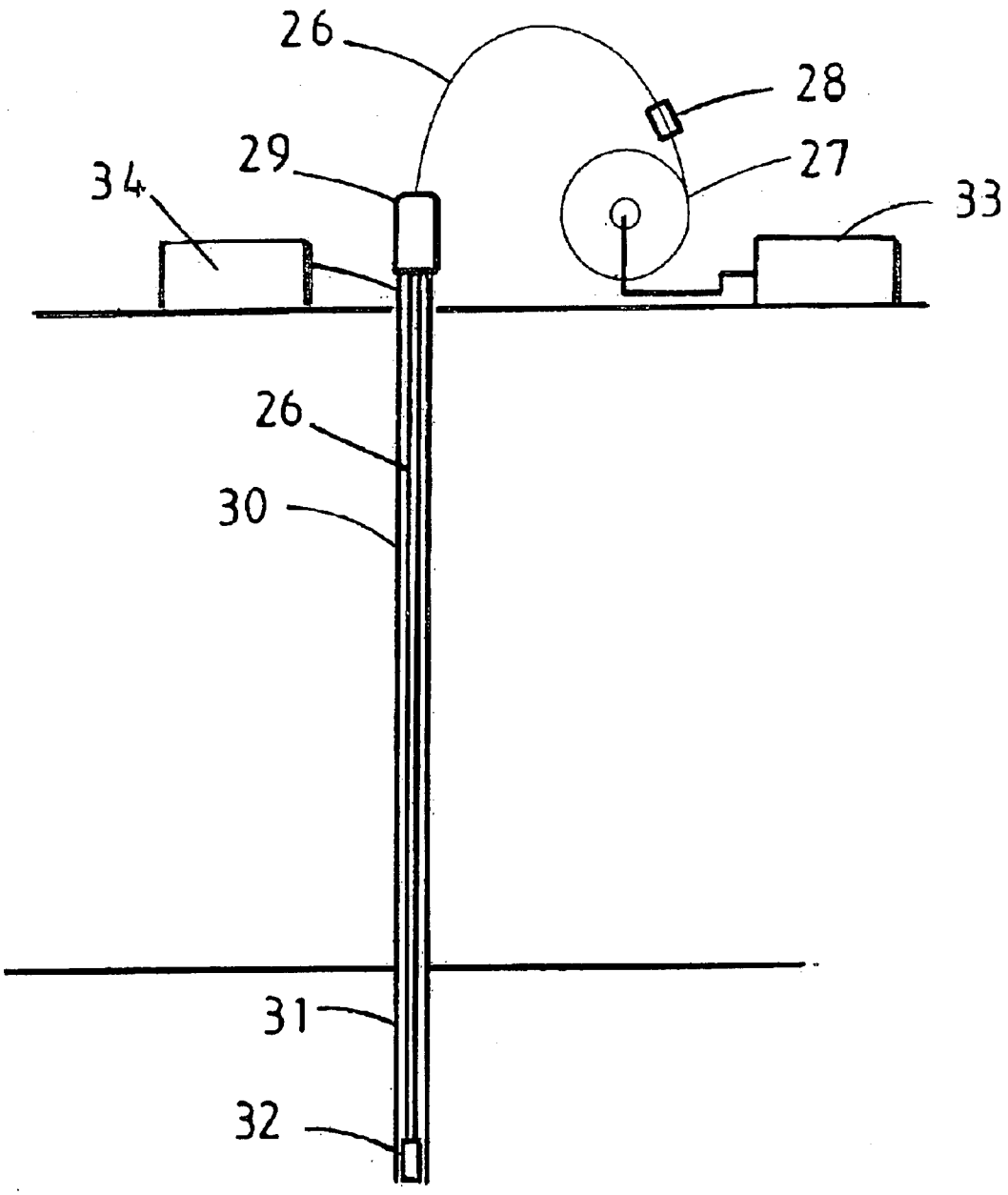
FIG. 6 illustrates equipment for underbalanced non-rotating drilling and illustrates a hydrocarbon liquid separator.

FIG. 6 shows coiled tube drilling equipment comprising a seamless tube 26 which is stored on a reel 27 and can be uncoiled from that reel and pushed into a well. The tube is passed through first and second injectors 28, 29 into riser 30 and through the riser into the well 31. The tube 26 supports on its end a bottom hole assembly 32 which includes a turbine drill powered hydraulically through the tube 26 from a hydraulic supply unit 33.

The system illustrated in FIG. 6 operates in an underbalanced drilling mode, that is the pressure in the hydrocarbon liquid-containing formation is greater than the pressure at the bottom of the well where drilling is taking place. This means that hydrocarbon liquid flows to the well, that flow passing up the riser and conveying with it solids produced by the drilling process. The multi-phase mixture flowing up the riser is passed to a separator 34 where the hydrocarbon liquids are separated from the mixture. Thus the pressure differential between the surface (on the tanker deck) and the bottom of the well when drilling is taking place is less than the pressure at the bottom of the well which in turn is less than the pressure at the bottom of the well which in turn is less than the pressure within the formation.

What is claimed is:

1. A subsea well intervention vessel comprising a dynamically positionable tanker and direct well intervention equipment mounted on a deck of the tanker, the direct well intervention equipment including equipment for underbalanced non-rotating drilling and hydrocarbon liquid separation coupled to storage tanks of the tanker such that separated hydrocarbon liquids can be stored in the tanker.

2. A vessel according to claim 1, wherein the well intervention equipment is mounted on a superstructure above the main deck of a shuttle tanker.

3. A vessel according to claim 1, wherein coiled tubing drilling equipment is mounted adjacent a skid deck which may be displaced to an outboard position over a well riser to which the coiled tubing drilling equipment is to be connected.

4. A vessel according claim 1, wherein coiled tubing drilling equipment is mounted adjacent a moon pool located over a well riser to which the coiled tubing drilling equipment is to be connected.

5. A method for conducting off-shore underbalanced drilling, wherein a tanker having direct well intervention equipment mounted on its deck is dynamically positioned over a riser extending from a subsea well, the well intervention equipment is coupled to the riser, and underbalanced non-rotating drilling is performed, the resultant multi-phase mixture being separated on the tanker and separated hydrocarbon liquids being stored in storage tanks of the tanker.

6. A method for conducting off-shore underbalanced drilling, wherein a tanker having coiled tubing drilling equipment mounted on its deck is dynamically positioned over a riser extending to a subsea production well, the coiled tubing drilling equipment including a non-rotating continuous coiled tube and a hydraulically driven drill mounted on one end of the tube, the coiled tubing drilling equipment is coupled to the riser and the tube is uncoiled and pushed through the riser into the production well so that the drill is located at a location where drilling is to be performed, hydraulic fluid is supplied to the drill through the tube to drive the drill, drilling being underbalanced such that a multi-phase mixture which includes hydrocarbon liquids and solids is produced at the drill location which is at a pressure greater than the pressure differential between that location and the tanker deck, the mixture is delivered to the tanker through the well and the riser, hydrocarbon liquids are separated from the mixture on the tanker, and the separated hydrocarbon liquids are stored in storage tanks of the tanker.

* * * * *